US006523189B1

(12) United States Patent
Weatherbee

(10) Patent No.: US 6,523,189 B1
(45) Date of Patent: Feb. 25, 2003

(54) POOL COVER APPARATUS

(76) Inventor: Diane A. Weatherbee, 16562 Albion Rd., Holley, NY (US) 14470

( * ) Notice: Subject to any disclaimer, the term of this patent is extended or adjusted under 35 U.S.C. 154(b) by 0 days.

(21) Appl. No.: 10/006,871

(22) Filed: Oct. 26, 2001

(51) Int. Cl.[7] ..... E04H 4/00
(52) U.S. Cl. ..... 4/498
(58) Field of Search ..... 4/498, 499, 500, 4/502, 503

(56) References Cited

U.S. PATENT DOCUMENTS 3,354,472 A * 11/1967 Steinbeck ..... 4/503
3,707,007 A 12/1972 Trostler
3,813,704 A 6/1974 Troiano
4,379,351 A * 4/1983 Hinsperger ..... 4/498
4,667,352 A 5/1987 Leister
5,067,182 A 11/1991 Koelsch
5,095,557 A 3/1992 Keyes
D330,087 S 10/1992 Mejias

* cited by examiner

*Primary Examiner*—Charles E. Phillips

(57) ABSTRACT

A pool cover apparatus for keeping debris out of a pool while allowing sunlight, rain, and air to enter the pool then the pool is not in use. The pool cover apparatus includes a cover portion comprising a mesh material with an elastomeric securing member attached to the outer perimeter for being selectively extended around the upper rim of the pool. A pocket removably receives a section of the cover portion for storage while the pool is in use.

11 Claims, 2 Drawing Sheets

POOL COVER APPARATUS

BACKGROUND OF THE INVENTION

1. Field of the Invention

The present invention relates to pool covers and more particularly pertains to a new pool cover apparatus for keeping debris out of a pool while allowing sunlight, rain, and air to enter the pool when the pool is not in use.

2. Description of the Prior Art

The use of pool covers is known in the prior art. U.S. Pat. No. 3,707,007 describes a pool cover arrangement for draping over the pool surface. Another type of pool covers is U.S. Pat. No. 5,067,182 having a series of buoyant panels which are hinged together to form a row of panels to float on the surface of the water in the pool.

While these devices fulfill their respective, particular objectives and requirements, the need remains for a device that has certain improved features that allow outside elements to come in contact with the water while preventing debris from entering the pool.

SUMMARY OF THE INVENTION

The present invention meets the needs presented above by having a cover member comprising a mesh material that is held taut over the top of the pool above the water.

Still yet another object of the present invention is to provide a new pool cover apparatus that utilizes an elastomeric securing member that is integrated into the cover member to quickly and easily allow the user to implement the apparatus.

Even still another object of the present invention is to provide a new pool cover apparatus that has a pocket for storing that portion that is rolled back to access the pool.

To this, the present invention generally comprises a cover portion comprising a mesh material with an elastomeric securing member attached to the outer perimeter for being selectively extended around the upper rim of the pool. A pocket removably receives a section of the cover portion for storage while the pool is in use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
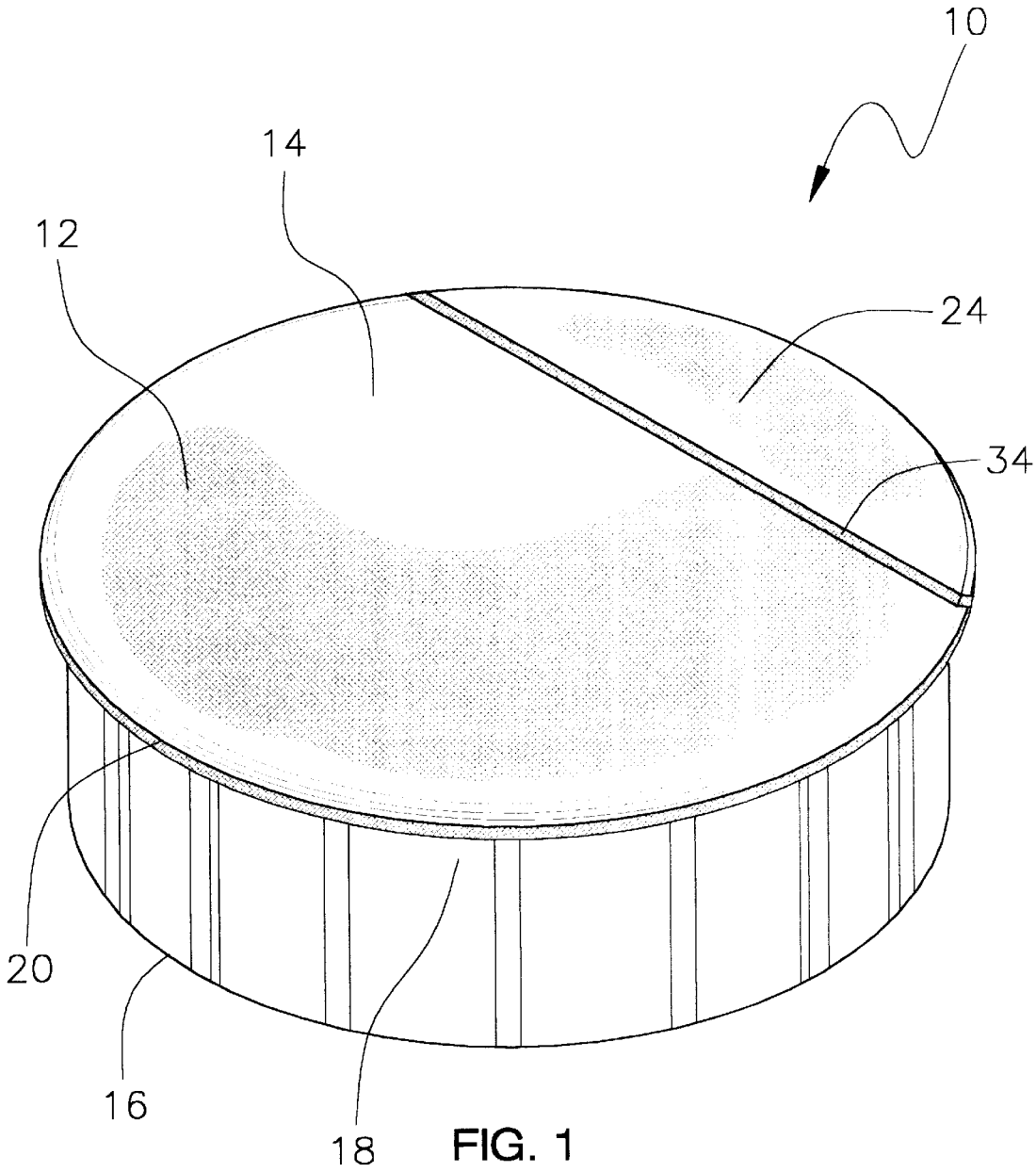
FIG. 1 is a schematic perspective view of a new pool cover apparatus according to the present invention.
Figure 2:
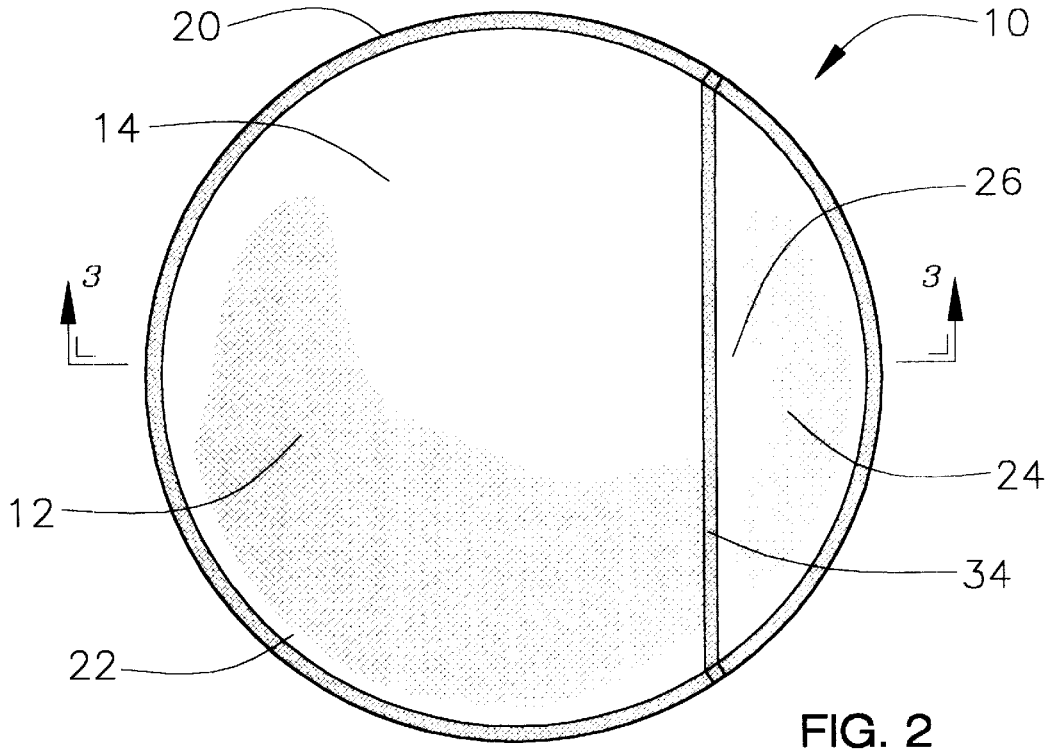
FIG. 2 is a schematic top view of the present invention.
Figure 3:
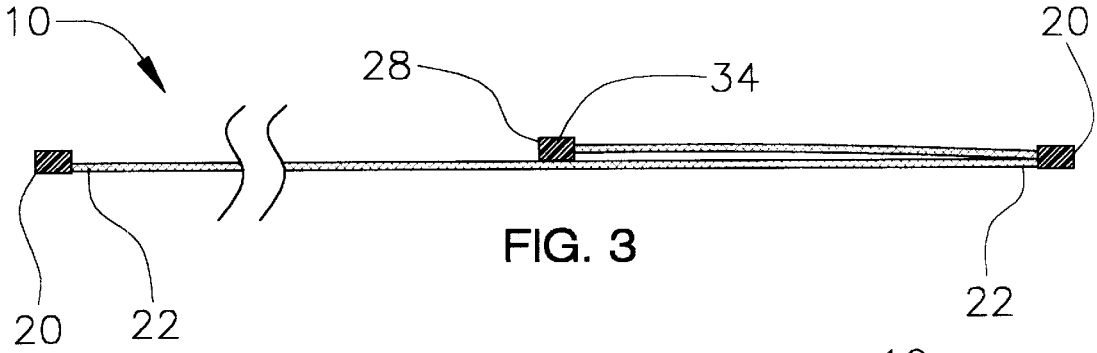
FIG. 3 is a schematic cross-sectional side view of the present invention.
Figure 4:
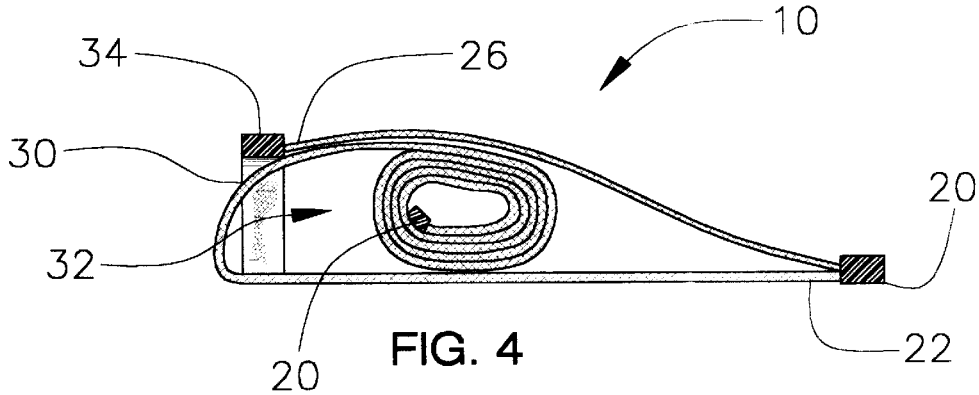
FIG. 4 is a schematic side view of the present invention in the stored position.

With reference now to the drawings, and in particular to FIGS. 1 through 4 thereof, a new pool cover apparatus embodying the principles and concepts of the present invention and generally designated by the reference numeral 10 will be described.

As best illustrated in FIGS. 1 through 4, the pool cover apparatus 10 generally comprises a cover portion 12 for covering the top section 14 of the pool 16. The cover portion 12 comprises a flexible mesh material thereby permitting rainwater, sunlight, and air to pass therethrough and minimizing the amount of debris allowed into the pool 16.

The cover portion 12 has a shape substantially equal to the pool rim 18, and is generally arcuate shaped.

A securing member 20 secures the cover portion 12 to the pool rim 18. The securing member 20 comprises an elastomeric material attached to and extending around a peripheral edge 22 of the cover portion 12. The securing member 20 is selectively extendable around the pool rim 18.

A pocket 24 removably receives the cover portion 12 therein. The pocket 24 is positioned on the cover portion 12 and a first edge 26 attached to and extending along a portion of the peripheral edge 22 of the cover portion 12 such that a free edge 28 of the pocket 24 is defined.

An opening 30 for accessing an interior of the pocket 32 is defined between the free edge 28 and the cover portion 12. An elastomeric strap 34 is attached to and extending along a length of the free edge 28. The pocket 24 generally extends over one third of the cover portion 12.

The section of the cover portion 12 that extends away from the pocket 24 may be positioned in the pocket 24.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pool cover apparatus for keeping debris out of a pool while allowing sunlight, rain, and air to enter the pool when the pool is not in use, the pool having an pool rim defining an opening into the pool, the apparatus comprising:

a cover portion for covering the top section of the pool, said cover portion having a peripheral edge;

a securing member for securing said cover portion to the pool rim, said securing member being mounted along said peripheral edge of said cover portion;

a panel secured to said cover portion to form a pocket therebetween for removably receiving a section of said cover portion extending away from said pocket, said panel having a first edge attached to and extending along a portion of said peripheral edge of said cover portion and a free edge of said panel extending across said cover portion; and an elastomeric strap being attached to and extending along a length of said free edge.

2. The pool cover apparatus as set forth in claim 1, wherein said cover portion comprising a flexible mesh material thereby permitting rainwater, sunlight, and air to pass therethrough and minimizing the amount of debris allowed into the pool.

3. The pool cover apparatus as set forth in claim 1, wherein said panel forming said pocket extends generally over approximately one third of said cover portion.

4. The pool cover apparatus as set forth in claim 1, wherein said cover portion has a generally circular shape.

5. The pool cover apparatus as set forth in claim 1, wherein said securing member comprising an elastomeric material attached to and extending around said peripheral edge of said cover portion.

6. The pool cover apparatus as set forth in claim 1, further comprising an opening for accessing an interior of said pocket being defined between said free edge and said cover portion.

7. A pool cover apparatus for keeping debris out of a pool while allowing sunlight, rain, and air to enter the pool when the pool is not in use, the pool having an pool rim defining an opening into the pool, the apparatus comprising:

a cover portion for covering the top section of the pool, said cover portion comprising a flexible mesh material thereby permitting rainwater, sunlight, and air to pass therethrough and minimizing the amount of debris allowed into the pool, said cover portion having a shape substantially equal to the pool rim, said cover portion having a generally arcuate shape;

a securing member for securing said cover portion to the pool rim, said securing member comprising an elastomeric material attached to and extending around a peripheral edge of said cover portion, said securing member being selectively extendable around the pool rim;

a pocket for removably receiving said cover portion therein, said pocket being positioned on said cover portion and a first edge attached to and extending along a portion of said peripheral edge of said cover portion such that a free edge of said pocket is defined;

an opening for accessing an interior of said pocket being defined between said free edge and said cover portion, an elastomeric strap being attached to and extending along a length of said free edge, said pocket generally extending over one third of said cover portion; and wherein a section of said cover portion extending away from said pocket may be positioned in said pocket.

8. A pool cover apparatus for keeping debris out of a pool while allowing sunlight, rain, and air to enter the pool when the pool is not in use, the pool having an pool rim defining an opening into the pool, the apparatus comprising a cover portion for covering the top section of the pool;

a securing member for securing said cover portion to the pool rim, said securing member being selectively extendable around the pool rim;

a pocket for removably receiving said cover portion therein; and wherein a section of said cover portion extending away from said pocket may be positioned in said pocket;

wherein said securing member comprising an elastomeric material attached to and extending around a peripheral edge of said cover portion;

wherein said pocket being positioned on said cover portion and a first edge attached to and extending along a portion of said peripheral edge of said cover portion such that a free edge of said pocket is defined;

an elastomeric strap being attached to and extending along a length of said free edge, said pocket generally extending over one third of said cover portion.

9. The pool cover apparatus as set forth in claim 8, wherein an opening for accessing an interior of said pocket is defined between said free edge and said cover portion.

10. The pool cover apparatus as set forth in claim 8, wherein said cover portion comprises a flexible mesh material for permitting rainwater, sunlight, and air to pass therethrough and minimizing the amount of debris allowed into the pool.

11. The pool cover apparatus as set forth in claim 8, wherein said cover portion has a generally circular shape.

* * * * *